US006550507B1

(12) United States Patent
Esnault et al.

(10) Patent No.: US 6,550,507 B1
(45) Date of Patent: Apr. 22, 2003

(54) THERMOTROPIC AROMATIC POLYESTER (AMIDE) MONOFILAMENT

(75) Inventors: Philippe Esnault, Clermont-Ferrand (FR); Jean-Claude Aubry, Clermont-Ferrand (FR)

(73) Assignee: Michelin Recherche et Technique S.A., Granges-Paccot (CH)

( * ) Notice: Subject to any disclaimer, the term of this patent is extended or adjusted under 35 U.S.C. 154(b) by 0 days.

(21) Appl. No.: 09/454,639

(22) Filed: Dec. 6, 1999

Related U.S. Application Data

(63) Continuation of application No. PCT/EP98/03386, filed on Jun. 5, 1998.

(30) Foreign Application Priority Data

Jun. 6, 1997 (FR) ..... 97/07142

(51) Int. Cl.[7] ..... B60C 9/00

(52) U.S. Cl. ..... 152/48; 152/556; 57/236; 57/238; 57/243

(58) Field of Search ..... 152/548, 556; 57/236, 238, 243; 428/373

(56) References Cited

U.S. PATENT DOCUMENTS

| | | | | | |
|---|---|---|---|---|---|
| 3,491,180 | A | | 1/1970 | Thoma et al. | 264/210 |
| 4,161,470 | A | | 7/1979 | Calundann | 260/40 |
| 4,734,240 | A | | 3/1988 | Chung et al. | 264/211.13 |
| 5,945,216 | A | * | 8/1999 | Flint et al. | 428/364 |
| 6,126,879 | A | * | 10/2000 | Sandor et al. | 264/177 |
| 6,127,028 | A | * | 10/2000 | Sandor et al. | 428/222 |
| 6,129,878 | A | * | 10/2000 | Haider et al. | 264/210.8 |
| 6,159,599 | A | * | 12/2000 | Sandort et al. | 428/373 |
| 6,187,437 | B1 | * | 2/2001 | Haider et al. | 428/395 |
| RE37,526 | E | * | 1/2002 | Flint et al. | 428/364 |

FOREIGN PATENT DOCUMENTS

| | | |
|---|---|---|
| EP | 0091253 | 10/1983 |
| GB | 828986 | 2/1960 |

* cited by examiner

*Primary Examiner*—Edward J. Cain
*Assistant Examiner*—Katarzyna Wyrozebski
(74) *Attorney, Agent, or Firm*—Baker Botts L.L.P.

(57) ABSTRACT

An as-spun monofilament of thermotropic aromatic polyester(amide), which satisfies the following conditions: $D \geqq 40$; $Te > 45$; $\Delta L \geqq 0$, D being its diameter (in $\mu$m), Te its tenacity (in cN/tex) and $\Delta L$ its variation in length (in %) after 2 minutes at 235±5° C. at an initial tension of 0.2 cN/tex. A spinning process for obtaining such a monofilament, including, upon emergence from the spinneret, of structuring the flow of the polymer by stretching in a layer of gaseous fluid for a predetermined time which is a function of the diameter D, before thermally quenching the flow of polymer thus structured in a liquid, so as to solidify it.

19 Claims, No Drawings

THERMOTROPIC AROMATIC POLYESTER (AMIDE) MONOFILAMENT

This is a continuation of PCT/EP 98/03386, filed Jun. 5, 1998.

BACKGROUND OF INVENTION

The present invention relates to thermotropic aromatic polyester(amide) fibers, more particularly to the monofilaments of such polymers, and to processes for obtaining such monofilaments.

The production from thermotropic aromatic polyester (amide) of conventional multifilament fibers formed of a large number of filaments of low elementary diameter (typically from about 20 to 30 μm) or of unit monofilaments of large diameter (at least 40 μm) by melt-spinning the polymer, generally followed by heat treatment referred to as post-polycondensation, is a known technique.

International Application WO 92/12018 (equivalent patents EP-B-517 870 and U.S. Pat. No. 5,427,165) describes in particular reinforcement assemblies intended to replace steel cables in tires, these assemblies being formed of monofilaments of liquid-crystal organic polymers having very high mechanical properties, in particular of aromatic polyester. To obtain these aromatic polyester monofilaments, the molten polymer is extruded at 340° C. through the capillary of a spinneret, the diameter of which is 800 μm and the temperature of which is 270° C.; the liquid jet emerging from the spinneret is stretched in air (stretching ratio about 20), then solidified by passing into a thermal quenching zone. The as-spun monofilament thus obtained is taken from a winding device at a speed of 590 m/min, then subjected to the post-polycondensation heat treatment on the takeup reel: this post-polycondensation phase, which is particularly long for this type of polymer (several hours) in fact involves the treatment being carried out on a reel, generally in an oven, and not on a single-thread passing continuously through this oven. After heat treatment, the monofilaments, for a diameter of about 180 μm, have the following mechanical properties: initial modulus of 4300 cN/tex, elongation at break of 2.5% and tenacity of 130 cN/tex. Owing to the liquid-crystal nature of the initial polymer, the single-threads, already in the as-spun state, have a very high initial modulus, greater than 4000 cN/tex, the post-polycondensation heat treatment being essentially intended to increase the tenacity of the spun products.

However, one major disadvantage of the as-spun monofilaments described above is that they have the special characteristic of contracting in the hot state. This property, which is probably linked to release from constraints "frozen" during spinning, makes it difficult to perform the subsequent post-polycondensation phase, and it is detrimental to the quality of the heat-treated monofilaments which derive therefrom, as is explained hereafter.

It happens that unless the monofilaments are allowed the possibility of contracting freely during their heat treatment, on their support reel, the latter will develop very major tensions which may result in partial damaging thereof, or even in self-breaking. Furthermore, there is the risk of interfilament "marriage" between adjacent or superposed turns, this risk being due to the combined action of the tension of contraction and of the temperature; such marriage, if it takes place, may prevent satisfactory later unwinding of the treated monofilaments.

In order to limit the above risks, although it has been attempted, before the treatment of the as-spun single-threads, to wind them up again at very low speed (several tens of meters per minute) to obtain as low as possible a tension on the support reel, this operation is costly from an industrial point of view and difficult to carry out when large lengths of monofilaments have to be treated. Attempts have also been made to utilise geometries of crossed overlapping winding limiting the contact between the threads, but the contraction then induces flexion-compression damage at the contact points.

To allow the monofilaments, on the contrary, the possibility of contracting freely during their treatment, experiments have been made using specific flexible reels which contract to a greater or lesser extent under the effect of the tension (variable diameter), this avoiding prior rewinding operations under very low tension. The use of such reels, although admittedly rather impractical and more costly, in particular reveals another major drawback of these as-spun monofilaments: their self-compression upon the thermal contraction in the majority of cases involves irreversible structural damage, revealed on the treated products by the presence of compression defects well-known under the name of "kink-bands", once a critical compression threshold, which is relatively low for this type of polymer, is exceeded.

Thus, whatever the solution adopted, none has hitherto proved completely satisfactory with respect to the various problems posed by as-spun single-threads which contract in the hot state, in particular during their thermal post-polycondensation treatment.

Some of the disadvantages described previously are moreover not specific to monofilaments of high diameter, and have already been described for conventional multifilament fibers of thermotropic aromatic polyester(amide).

Nevertheless, all these drawbacks are generally exacerbated on monofilaments owing to their greater diameter: the damage to a filament after heat treatment may for example pass unnoticed on a multifilament fiber formed of several hundreds of filaments, whereas it most frequently becomes crippling on a unit monofilament of large diameter.

SUMMARY OF THE INVENTION

The first object of the invention is to overcome the above drawbacks by proposing a new monofilament of thermotropic aromatic polyester(amide) which, in the as-spun stage, has the characteristic of not contracting when hot.

This as-spun monofilament satisfies the following conditions: $D \geqq 40$; $Te > 45$; $\Delta L \geqq 0$, D being its diameter (in μm) or its thickness in the case of an oblong or flattened shape, Te its tenacity (in cN/tex) and ΔL its variation in length (in %) after 2 minutes at 235±5° C. at an initial tension of 0.2 cN/tex.

When the monofilament of the invention is intended to reinforce articles of plastics material and/or of rubber, in particular tires, D preferably lies within a range from 80 to 230 μm, more preferably from 100 to 200 μm.

Compared with the monofilaments of thermotropic aromatic polyester(amide) of the prior art, in particular within the range of 80 to 230 μm above, the as-spun monofilament of the invention has the advantage of having, for a given polymer and a given diameter D, a lower tensile modulus combined with an elongation at break which is generally higher, which constitutes an advantageous compromise. For it is known that generally, for fibers of liquid-crystal origin having very high mechanical properties, such a combination favours better flexion-compression properties, which are particularly desired when articles of plastics material and/or of rubber, in particular tires, have to be reinforced; this better compromise observed on the as-spun monofilaments is retained on the heat-treated monofilaments which derive therefrom.

Thus, preferably, the as-spun monofilament of the invention satisfies the conditions:

Mi<4000; Ar>2, Mi being its initial modulus (in cN/tex) and Ar its elongation at break (in %).

The monofilament of the invention is obtained by means of a novel, specific spinning process which constitutes another subject of the invention, this process being characterized in that it comprises the following stages:

a) melting the polymer;

b) extruding the molten polymer through a spinneret comprising at least one extrusion capillary;

c) on emerging from the capillary, structuring the flow of the polymer by stretching in a layer of gaseous fluid, preferably air, for a predetermined time ts;

d) at the end of the time ts, thermally quenching the flow of polymer thus structured by passing it through a quenching liquid, preferably water, so as to solidify it;

e) after possibly drying it, winding the monofilament thus obtained, the time ts (in seconds) being linked to the diameter or thickness D (in $\mu$m) of the as-spun monofilament by the following condition (1):

$$ts<to=6\times10^{-6}D^2.$$

The as-spun monofilament of the invention can be used as such, or alternatively heat treated to obtain a monofilament of post-polycondensed thermotropic aromatic polyester (amide), which constitutes another subject of the invention.

The invention furthermore relates to the use of the monofilaments of the invention, be it in the state of an assembly or of a unit thread, for reinforcing articles of plastics materials and/or of rubber, and also to these articles themselves, in particular the rubber plies intended for manufacturing tires and these tires themselves.

The invention, and its advantages, will be readily understood in the light of the following description and examples of embodiment.

DESCRIPTION OF PREFERRED EMBODIMENTS

I. MEASUREMENTS AND TESTS USED

I-1. Optical properties of the polymers

The optical anisotropy of the polymers is tested by observing, in the molten phase (i.e. above the melting temperature of the polymer) a drop of polymer between the linear crossed polarizer and analyzer of an optical polarizing microscope (Olympus type BH2) at rest, that is to say in the absence of dynamic stress.

In known manner, if the polymer is thermotropic (i.e. liquid-crystal), the preparation above is optically anisotropic, that is to say, depolarizes light: when thus placed between a linear crossed polarizer and analyzer it transmits light (more or less colored texture); an optically isotropic preparation, under the same observation conditions, does not have the above property of depolarization, the field of the microscope remaining black.

I-2. Mechanical properties of the monofilaments

In the present description, "single-thread" or "monofilament" is understood to mean a unit filament, the diameter or thickness of which (that is to say, the smallest transverse dimension of its cross-section when this is not circular), referred to as D, is at least 40 $\mu$m (minimum linear density of 1.7 tex).

The above definition therefore covers equally well monofilaments of essentially cylindrical shape (i.e. with a circular section) and oblong monofilaments, flattened monofilaments or even strips or films of thickness D.

All the mechanical properties below are measured on monofilaments which have undergone prior conditioning; "prior conditioning" is understood to refer to the storage of the monofilaments (after drying) before measurement, in a standard atmosphere in accordance with European Standard DIN EN 20139 (temperature of 20±2° C.; moisture content of 65±2%) for at least 24 hours.

The linear density of the monofilaments is determined on at least three samples, each corresponding to a length of 50 m, by weighing this length of monofilament. The linear density is given in tex (weight in grams of 1000 m of monofilament—reminder: 0.111 tex=1 denier).

The mechanical properties in extension (tenacity, initial modulus and elongation at break) are measured in known manner using a Zwick GmbH & Co (Germany) 1435-type or 1445-type tension machine. The monofilaments undergo traction over an initial length of 400 mm, at a nominal speed of 50 mm/min. All the results given are an average of 10 measurements.

The tenacity (breaking load divided by linear density) and the initial modulus are indicated in cN/tex (centinewtons per tex—reminder: 1 cN/tex=0.11 g/den (grams per denier)). The initial modulus is defined as the gradient of the linear part of the force-elongation curve, which occurs just after a standard pretension of 0.5 cN/tex. The elongation at break is indicated as a percentage.

The diameter D of the monofilaments is determined by calculation from the linear density of the monofilaments and of their density, in accordance with the formula:

$$D=2\times10^{1.5}[Ti/\pi\rho]^{0.5},$$

D being expressed in $\mu$m, Ti being the linear density in tex, and $\rho$ being the volume mass in g/cm$^3$ ($\rho$ is equal to about 1.4 in the present case).

In the case of a monofilament having a non-circular cross-section, that is to say one which is other than a monofilament of essentially cylindrical shape, the parameter D, when then represents the smallest dimension of the monofilament in a plane normal to the axis of the latter, is determined not by calculation but experimentally, by an optical microscope on a transverse section of this monofilament, the latter being, for example, coated in a resin beforehand to facilitate cutting.

I-3. Test of thermal variation in length

The thermal behavior of the monofilaments is analysed, after prior conditioning, using a test called the "test of thermal variation in length", the principle of which is well-known to the person skilled in the art in the field of textile fibers.

In this test, the thermal variation in length, $\Delta L$, is measured by introducing monofilaments, under an initial tension of 0.2 cN/tex, into an oven which has first been set to a temperature of 235° C.±5° C.

In practice, a known commercial apparatus of the "Testrite" type (model MK3, sold by Testrite) is used. The useful length of the sample (without significant effect on the measurement) is 254 mm. $\Delta L$ is measured automatically by the apparatus, by means of mechanical sensors, and the result of the measurement is read off from a digital display, after 2 minutes at the temperature of 235° C.±5° C.; a positive variation $\Delta L$ corresponds to dilation of the monofilaments, whereas a negative variation $\Delta L$ corresponds to contraction of the latter.

II. CONDITIONS OF CARRYING OUT THE INVENTION

II-1. Polymer

The initial polymer is any thermotropic aromatic polyester or polyesteramide which can be spun in the molten state. Such polyesters or polyesteramides, which are referred to as "fully aromatic", are known to the person skilled in the art and have been described in a very large number of documents.

By way of example, the following patents or patent applications will be cited: EP 091 253; EP 205 346; EP 267 984; EP 508 786; EP 737 707; U.S. Pat. Nos. 3,491,180; 4,083,829, 4,161,470; 4,183,895; 4,447,592; 4,734,240; 4,746,694; 5,049,295; 5,110,896; 5,250,654; 5,296,542; JP 1992/333 616; JP 1996/260 242.

The invention is preferably implemented starting with a specific thermotropic aromatic polyester; this polymer consists essentially of recurrent units (A) of 6-oxy-2-naphthoyl and (B) of 4-oxybenzoyl:

A :

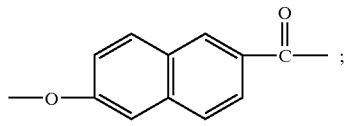

B :

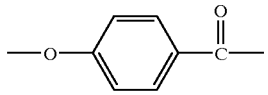

the molar ratio A:B lying within a range from 10:90 to 90:10, preferably 20:80 to 30:70.

Such a polymer, which is sold in particular by the company Hoechst Celanese under the name Vectra, was described in U.S. Pat. No. 4,161,470, and may be obtained by copolymerisation of p-hydroxybenzoic acid and 6-hydroxy-2-naphthoic acid, these two acids possibly being substituted. It has, in known manner, an excellent compromise of properties in terms of heat resistance, chemical resistance, ease of working and suitability for spinning, owing in particular to a relatively low melting point (referred to hereafter as Tm). A polymer of this type—Vectra type 900 or 950 with a molar ratio of A:B of 27:73—is widely known for conventional multifilament fibers (see, for example, J. Text. Inst. 1990, 81, No. 4, pp. 561-574) and has also been used to obtain monofilaments of the prior art described in Application WO 92/12018 referred to above.

II-2. Spinning

The initial polymer, for example in the form of granules or powder, is dried in a vacuum and then introduced into an extruder having one or more different heating zones. Just as for the spinning of conventional multifilament fibers, the temperatures and the dwell times imposed within these different zones are such that they permit complete melting of the polymer, stable rotation conditions and extrusion screw torque conditions affording regular supplying of the spinning pump, and finally make it possible to avoid degradation of the polymer in the extruder.

On emerging from the extruder, the molten polymer, which is then at the temperature Tx (extruder exit temperature), is transferred to a spinning pump which supplies a spinneret preceded by a filter.

The spinneret may comprise a single extrusion capillary or several, depending on whether it is desired to spin one single-thread or several single-threads in parallel; the case of a spinneret comprising a single capillary will be considered hereafter.

The diameter of the capillary, referred to as "d", is not a critical parameter of the process: it may vary within a wide range, for example from 200 to 1500 μm, or even more, depending on the intended diameter D. As indicated previously, the invention also relates to those cases in which the monofilaments have a cross-section which is other than circular, such a form possibly being obtained, for example, by modifying the cross-section of the extrusion capillary; for such monofilaments, the parameter d then represents the smallest transverse dimension of the capillary, i.e. its smallest dimension measured in a plane normal to the direction of flow of the polymer.

Preferably, the spinneret temperature Tf is less than the temperature Tm (melting temperature of the polymer).

On emerging from the spinneret and the extrusion capillary, therefore a liquid extrudate (flow of polymer) is obtained consisting of an elementary liquid vein in the form of a still-liquid monofilament. This liquid vein of polymer is then structured, oriented by stretching (see spin-stretch factor FEF below) in a layer of gaseous fluid, for a predetermined time ts, before penetrating into a liquid thermal quenching zone.

By convention, structuring time ts is understood here to mean the total passage time for the flow of polymer in the layer of gaseous fluid, whatever the profile or gradient of stretching of the flow in this layer of gaseous fluid.

The layer of gaseous fluid is preferably air, the thickness Ag of which may vary, for example, from several centimeters to several meters, depending on the specific conditions of implementation of the invention, in particular depending on the times ts intended. "Thickness Ag of the layer of gaseous fluid" is understood to mean the distance between the exit from the spinneret and the entrance to the liquid thermal quenching zone. Preferably, the temperature Tc of the layer of gaseous fluid is significantly less than Tf, Tc generally being close to ambient temperature (about 20° C.).

According to the invention, the structuring time ts (in seconds) is linked to the diameter D (in μm) of the as-spun monofilament by the following condition (1):

$$ts<to=6\times10^{-6}D^2.$$

A structuring time ts lower than the critical value to above is a necessary condition to guarantee that, whatever the diameter D intended, an as-spun monofilament which does not contract in the hot state (i.e. having a variation $\Delta L \geqq 0$ in the test of thermal variation in length) is obtained.

Preferably, the following condition (2) is satisfied:

$$1.5\times10^{-6}D^2<ts<6\times10^{-6}D^2.$$

It is in fact desirable that the structuring times ts not be too short, if it is desired to obtain monofilaments having sufficient strength to be able to be used to reinforce rubber articles such as tires.

It has been observed that the implementation of the process of the invention in accordance with condition (2) above, for the spinning of monofilaments of a diameter D of 80 to 230 μm, more preferably 100 to 200 μm, in particular from the polymer having recurrent units A and B previously defined, was particularly beneficial to obtaining an initial modulus Mi of between 2500 and 4000 cN/tex, more preferably at least equal to 3000 cN/tex and less than 4000 cN/tex. For such preferred conditions, when the process is used to obtain single-threads of circular section of a diameter of 100 to 200 μm, furthermore, more preferably, the following conditions are used: the spinning rate (see Vf hereafter) lies within a range from 500 to 1000 m/min and the thickness of the layer of gaseous fluid (Ag) is selected to be greater than 0.50 meters and less than 2.0 meters.

At the end of the time ts, the flow of polymer thus structured and oriented penetrates into the liquid thermal quenching zone where, in contact with the liquid agent, it solidifies and thus forms a monofilament. Preferably, the liquid thermal quenching agent is water, and its temperature T1 is preferably less than ambient temperature, for example of the order of 10 to 15° C.

For this liquid thermal quenching operation, simple means may be used, consisting, for example, of a bath containing the quenching liquid and through which the single-thread being formed circulates. The liquid quenching time is not a critical parameter, and may vary, for example, from several milliseconds to several tenths of a second, or even several seconds, depending on the specific conditions of implementation of the invention.

It is generally on emerging from the liquid thermal quenching zone that the monofilament is taken up on an entraining device, for example a takeup roller, at a given speed referred to as the spinning rate, Vf. The ratio between Vf and the rate of extrusion Ve of the solution through the spinneret defines what is called in known manner the spin-stretch factor (abbreviated FEF=Vf/Ve).

Typically, the spin-stretch factor and the spinning rate may vary within a very wide range, for example from 2 to 50 for the FEF and from 100 to 1500 m/min for Vf.

It has been noted that the mechanical properties of the monofilaments were influenced very little by the spin-stretch factor for ranges as large as those indicated above, whereas they turned out to be particularly sensitive to the structuring time ts before the liquid thermal quenching. In other words, unexpectedly, the properties obtained are essentially dependent, at a given diameter D, on the structuring time and not on the amplitude of deformation imposed during stretching.

The as-spun monofilament thus obtained is then wound at the speed Vf on to a takeup reel. It may possibly be dried before winding, for example by passing continuously over heating rollers, or alternatively be wound in the wet state and then dried on the reel, for example in ambient air or at a higher temperature in an oven, before prior conditioning for measuring its thermal and mechanical properties.

As a general rule, the initial modulus Mi and the elongation at break Ar of the monofilament of the invention can be largely modulated by the selection of the initial polymer and of the spinning conditions, the initial modulus in particular being the higher the greater the rigidity of the polymer (use for example of thermotropic polyesteramides).

Preferably, for a better flexion/compression performance, the as-spun monofilament of the invention satisfies the following conditions:

$$Mi<4000;\ Ar>2,$$

Mi being its initial modulus (in cN/tex) and Ar its elongation at break (in %).

It has furthermore been observed that most frequently an elongation at break which is even higher was associated with a value $\Delta L \geqq 0.2$; thus, more preferably, the following conditions are both satisfied:

$$\Delta L \geqq 0.2;\ Ar \geqq 2.5.$$

When the monofilaments according to the invention are intended to reinforce rubber articles, in particular tires, their tenacity in the as-spun state is preferably greater than 55 cN/tex, more preferably greater than 65 cN/tex; their initial modulus, in the as-spun state, is preferably between 2500 and 4000 cN/tex, more preferably at least 3000 cN/tex and less than 4000 cN/tex.

II-3. Post-polycondensation treatment

The thermal post-polycondensation treatment, after spinning, essentially makes it possible to increase the tenacity available on the monofilaments by increasing the degree of polymerization of the polymer; generally, the more pronounced the thermal treatment, the higher the tenacity obtained after treatment. Thus, monofilaments of what is called post-polycondensed thermotropic aromatic polyester (amide) are obtained, which derive directly from the as-spun single-threads described previously.

For this treatment, the reels of as-spun monofilaments are treated in ovens in known manner, at high temperature, in a vacuum or under inert gas, for example under a flow of nitrogen, generally for several hours. The conditions of this post-polycondensation treatment, which in known manner vary according to the nature of the polymer used, are similar to those used for conventional multifilament fibers. Particular treatment conditions have been described, for example, in U.S. Pat. No. 4,161,470 for these conventional fibers, and in Application WO 92/12018 referred to above for monofilaments of a diameter of 180 $\mu$m; such conditions are also given in the examples of embodiment which follow.

Preferably, the monofilament of post-polycondensed thermotropic aromatic polyester(amide) deriving from the as-spun monofilaments of the invention, of diameter D of at least 40 $\mu$m, satisfies the following conditions:

Mi<4000; Ar>2; Te>100, Mi being its initial modulus (in cN/tex), Ar its elongation at break (in %) and Te its tenacity (in cN/tex). More preferably, its modulus Mi is between 2500 and 4000 cN/tex, more preferably still at least equal to 3000 cN/tex and less than 4000 cN/tex; its elongation at break Ar is preferably at least 2.5.

The as-spun monofilaments of the invention, like those in the post-polycondensed state which derive therefrom, may be used in various applications, in particular for producing or reinforcing various articles, in particular articles of plastics materials and/or of rubber, for example belts, tubes or tires.

When they are used for reinforcing articles of plastics material and/or rubber, in particular in the form of cables, they preferably satisfy the following condition (D in $\mu$m):

$$80 \leqq D \leqq 230.$$

A diameter of at least 80 $\mu$m is preferred, taking into account the costs of cabling (necessity of limiting the number of threads in the cables for a given breaking load), whereas a diameter greater than 230 $\mu$m is generally to be avoided in order to restrict the flexion-compression damage (disadvantage of large diameters under a low radius of curvature). Furthermore, a diameter greater than 230 $\mu$m is not very compatible with obtaining a sufficient tenacity, in particular for reinforcing tires.

More preferably still, when the single-threads of the invention are used to reinforce tires, the following condition is satisfied:

$$100 \leqq D \leqq 200.$$

III. EXAMPLES OF EMBODIMENT OF THE INVENTION

Test 1

The object of this test is to demonstrate the sensitivity of the properties of a monofilament of thermotropic aromatic polyester, of given diameter D, to the structuring time ts. 6 examples of as-spun monofilaments are produced, 5 of which are in accordance with the invention (examples A-1 to E-1), and a comparative example F-1, which is not in accordance with the invention.

The thermotropic aromatic polyester used here is a known polymer of the type Vectra A900, in the form of granules, sold by the company Hoechst Celanese, consisting of recurrent units (A) and (B) as defined above, in a molar ratio A:B of about 27:73 (Tm equal to 280° C. according to DSC).

The extruder in which the polymer is melted comprises three successive heating zones, at 275° C., 310° C. and 340° C. respectively (Tx=340° C.), the following spinning pump also being kept at the temperature Tx of 340° C. The temperature Tf and the diameter d of the single capillary of the spinneret are equal to 270° C. and 800 μm, respectively. The length "l" of the capillary is equal to twice its diameter (l/d=2) and the angle α of the convergent preceding the entry to the capillary is 8 degrees. The FEF is equal to 19.7 (Vf=590 m/min). The spinning conditions are adjusted in known manner, by influencing the speed of the spinning pump and the rate of extrusion through the spinneret, so as to obtain a monofilament of diameter D of about 180 μm (linear density equal to about 34.5 tex).

On emerging from the extrusion capillary, the flow of the polymer (i.e. the liquid vein emerging from the capillary) is structured by stretching in a layer of air (ambient temperature 20° C.) for a time ts which is variable such that condition (1) above (namely ts<to=0.19 s) is satisfied or not.

At the end of the time ts, the flow of polymer thus structured is thermally quenched by forced passage of the monofilament beneath a pulley immersed in a bath of water at 15° C.; the length of monofilament immersed is about 10 cm, which corresponds to a very short, but adequate, thermal quenching time of about 10 milliseconds. Upon emerging from the water bath, the monofilament is taken up and wound in several turns on an entraining device consisting of a takeup roller, at the speed Vf of 590 m/min indicated above.

The monofilament is then taken from a reel, in the wet state, and is allowed to dry in air for 24 hours, before prior conditioning for measuring its thermal and mechanical properties.

Thus the structuring time ts was varied in accordance with what is shown in Table 1—namely from 0.02 to 0.40 sec—by gradually increasing the thickness Ag of the air-gap from 0.2 m (example A-1) to 3.9 m (Example F-1), passing in succession through values Ag of 0.55 m (Example B-1), 0.75 m (Example C-1), 1.10 m (Example D-1) and 1.60 m (Example E-1). All the spinning conditions are in accordance with the invention, with the exception of the time ts for Example F-1, which does not satisfy the above condition (1) (ts<to).

Table 1 also shows the properties of the monofilaments obtained.

It will be noted that the single-threads prepared according to the spinning process according to the invention (Examples A-1 to E-1) all satisfy the following conditions:

$$D \geqq 40;\ Te > 45;\ \Delta L \geqq 0.$$

Examples A-1 to D-1 furthermore satisfy the following preferred conditions: Mi<4000; Ar>2.

Furthermore, Examples A-1 to B-1, obtained for the shortest structuring times ts, satisfy the following preferred conditions: ΔL≧0.20; Ar≧2.5.

The initial modulus may thus be lowered to values of between 2500 and 4000 cN/tex without adversely affecting the tenacity, which in all cases remains greater than 65 cN/tex.

It will be noted in particular that the monofilaments B-1, C-1, D-1 and E-1 (diameter 180 μm), which are obtained using a process which satisfies condition (2) above, namely:

$1.5\times10^{-6}\ D^2$ (or 0.049 sec)<ts<$6\times10^{-6}D^2$ (or 0.194 sec), all have the following preferred characteristic: 3000≦Mi<4000.

As for Example F-1 prepared using a spinning process not in accordance with the invention (ts>to), it shows contraction in the hot state (negative ΔL), and is therefore not in accordance with the invention; it furthermore has a particularly high initial modulus, greater than 4000 cN/tex, and a value Ar of less than 2%.

It will therefore be noted in this test that the parameters ΔL, Mi and Ar are particularly sensitive to an increase in ts. In particular, the continuous increase in the initial modulus Mi with ts—and hence with the thickness Ag of the air-gap—appears somewhat unexpected insofar as the person skilled in the art might have expected to observe, on the contrary, for air-gap thicknesses which might achieve several meters, a decrease in the initial modulus due to molecular relaxation processes in the liquid-crystal flow of the polymer.

It is furthermore noted in this test that the monofilaments according to the invention have a significant thermal dilation (ΔL≧0.2 for all the examples; ΔL≧0.4 in the majority of cases); advantageously, such properties may in particular permit their winding at high tension, during spinning, before the subsequent post-polycondensation treatment.

Test 2

In this test, the procedure is the same as for Test 1 above, apart from the following modifications:

- the thermotropic aromatic polyester is a known polymer of the type Rhodester CL, manufactured by the company Rhône-Poulenc (Tm=305° C.), produced from the following monomers (mole %): p-acetoxybenzoic acid (23%), terephthalic acid (19%), methylhydroquinone diacetate (39%) and 4,4'-diphenyletherdicarboxylic acid (19%);
- the three successive heating zones of the extruder are at 330° C. (Tx=330° C.), the temperature of the pump is 310° C., and the temperature of the spinneret is 270° C. (Tf=270° C.);
- the diameter of the capillary of the spinneret is equal to 400 μm (l/d=2; α=8°), and the FEF is equal to 4.9 (Vf=590 m/min).

The structuring time ts is varied in accordance with what is shown in Table 2 by gradually increasing the thickness Ag of the air-gap from 0.55 m (example A-2) to 4.00 m (Example D-2), passing through values Ag of 0.80 m (Example B-2) and 2.20 m (Example C-2). All the spinning conditions are in accordance with the invention, with the exception of the time ts, which, for Examples C-2 and D-2, does not satisfy the above condition (1) (namely ts<to=19 sec); for Examples A-2 and B-2, condition (2) is satisfied.

Table 2 also shows the properties of the as-spun monofilaments thus obtained.

It will be noted that the single-threads of Examples A-2 and B-2, prepared according to the process of the invention, satisfy the following conditions:

$$D \geqq 40;\ Te > 45;\ \Delta L \geqq 0.$$

These single-threads A-2 and B-2 furthermore satisfy the following preferred conditions: Mi<4000 and Ar>2; their tenacity Te is greater than 55 cN/tex.

As for the single-threads of variants C-2 and D-2, although they do have an initial modulus Mi which is significantly less than 4000 cN/tex, owing simply to the nature of the polymer used (rigidity and optical anisotropy less than for the polymer of Test 1 above), they both show a negative ΔL variation, i.e. thermal contraction in the hot state in the test of thermal variation in length; they are therefore not in accordance with the invention.

Test 3

In this test, the procedure is the same as for Test 2 above, apart from the following modifications:

- the diameter d of the capillary of the spinneret is 600 μm (l/d=2; α=8°);
- the thickness Ag of the air-gap is constant and equal to 1.4 m;
- the diameter D of the monofilament is varied at a constant structuring time ts (ts=0.14 sec), in accordance with what is shown in Table 3.

The spinning rate is constant (Vf=590 m/min); the diameter D is adjusted from 95 μm (Example A-3) to 320 μm (Example G-3) by modifying the speed of the spinning pump in known manner (FEF varying from about 3.5 to about 40).

All the spinning conditions are in accordance with the invention, with the exception of the time ts, which, for the four examples referenced A-3 to D-3, does not satisfy the above condition (1) (ts=0.14 sec>to , for these four examples A-3 to D-3).

Table 3 also shows the properties of the monofilaments obtained. It will be noted that the single-threads of Examples E-3, F-3 and G-3, prepared according to the process of the invention (ts<to), do all satisfy the following conditions:

$$D \geqq 40;\ Te > 45;\ \Delta L \geqq 0.$$

These single-threads according to the invention furthermore satisfy the following preferred conditions: Mi<4000 and Ar>2; the Te is greater than 55 cN/tex for the single-threads E-3 and F-3.

As for the single-threads of Examples A-3 to D-3, prepared according to a process which is not in accordance with the invention (ts>to), although they do, like for Examples C-2 and D-2 above, have an initial modulus Mi which is less than 4000 cN/tex (polymer less rigid than for Test 1), they are all characterized by a negative ΔL variation, i.e. by thermal contraction in the hot state in the test of thermal variation in length; they are therefore not in accordance with the invention.

Test 4

In this test, the single-threads of Examples A-2 to D-2 above (Test 2) are subjected to post-polycondensation heat treatment.

For all the starting products, low-speed rewinding is effected (crossed overlapping winding of about 30°) on flexible reels capable of retracting to a greater or lesser extent under the effect of the thermal contraction of the single-threads which they support. This heat treatment is effected by placing the reels in ovens, under a vacuum, and by applying three thermal plateaux thereto: 50 min at 88° C. (for vacuum drying); 40 min at 178° C.; then 10 hours at 280° C.

Table 4 indicates the properties of the monofilaments in the post-polycondensed state A-4, B-4, C-4, D-4 which are thus obtained, respectively from as-spun single-threads A-2, B-2, C-2, D-2.

It will be noted that the as-spun monofilaments according to the invention (A-2 and B-2) are those which, after heat treatment, result in the products (A-4 and B-4) having the greatest tenacities (Te>100 cN/tex) and the highest elongations at break (Ar>2.5%).

Compared with the monofilaments according to the invention, monofilaments C-4 and D-4 prepared in accordance with the prior art have a substantially lower tenacity, a lesser elongation at break, and a degraded general appearance: they contain, in particular, a large number of "kink-bands" at the crossing points of the turns, on the treatment reel.

Test 5

In the following test, an oblong monofilament of a linear density of 230 tex is produced from the Vectra A900-type polyester used for Test 1. Its thickness D (smallest dimension of its cross-section) is equal to 160 μm, whereas its width (largest dimension of its cross-section) is equal to 1.2 mm; the form of this monofilament, which is extremely flattened, is therefore practically that of a film.

The procedure is the same as for Test 1 above, apart from the following differences:

- the capillary of the spinneret is of rectangular section (with rounded corners, for a better stability of flow), of dimension of 5.45 mm by 0.20 mm (that is to say d=200 μm; with l/d=2.5; α=8°);
- for melting the polymer, the three successive heating zones preceding the spinning pump are respectively at 295° C., 335° C. and 330° C. (Tx=330° C.), the following spinning pump being maintained at the temperature of 310° C.;
- the spinneret temperature (Tf) is 269° C.;
- the FEF is equal to 7.6 (Vf=180 m/min);
- the height of the layer of air, on emerging from the spinneret, is 150 mm, which corresponds to a structuring time ts of 0.05 seconds.

It will be noted in particular that condition (2) above is satisfied, ts being clearly included between $1.5\times10^{-6}$ $D^2$ (or 0.038 sec in the present case) and $6\times10^{-6}$ $D^2$ (or 0.154 sec in the present case).

The properties of the oblong as-spun monofilament thus obtained are as follows:

$$Te=57;\ \Delta L=+0.73;\ Mi=3050;\ Ar=2.6.$$

The following preferred conditions are thus satisfied:

$$100 \leqq D \leqq 200;\ \Delta L \geqq 0.2;\ Ar \geqq 2.5;\ 3000 \leqq Mi < 4000.$$

This monofilament is then subjected to post-polycondensation heat treatment, by placing the reel of monofilament in an oven, under vacuum, and by applying thereto the following thermal ramps and plateaus: thermal ramp of 2° C./min from ambient temperature to 195° C.; then thermal ramp of 0.3° C./min from 195° C. to 241° C.; then 2 hours at 241° C.; then thermal ramp of 0.1° C./min from 241° C. to 285° C.; finally, 3 hours at 285° C.

The oblong monofilament thus obtained in the post-polycondensed state has, for a linear density of 227 tex, a tenacity greater than 100 cN/tex (precisely 101 cN/tex, which corresponds to a breaking load of about 23 daN), an initial modulus Mi of between 3000 and 4000 cN/tex (precisely 3600 cN/tex) and an elongation at break Ar greater than 3% (precisely 3.4%). It should be noted that the relatively moderate tenacity of the single-thread thus obtained is explained in this case by a heat treatment time which is relatively short; longer heat treatment, such as that described, for example, in Test 4 above, normally results in significantly higher tenacities, for example of the order of 130 to 160 cN/tex, for this type of polymer.

Reinforcement of Rubber Articles

The monofilaments according to the invention, in the state of unit threads (in particular when they are oblong monofilaments or films) or in the state of cables or assemblies, are preferably used for reinforcing rubber articles, in particular rubber plies for tire manufacture.

For manufacturing cables or assemblies, twisting or cabling processes and devices are used which are known to the person skilled in the art, these not being described here in order to simplify the description. In particular, a technique such as that described in Application WO 92/12018 referred to above can be used to obtain layered cables.

These cables or unit threads must first be sized with one or more adhesive compositions capable of ensuring their adhesion to the rubber matrix which they are intended to reinforce.

For example, a two-stage sizing process is used, as indicated below:

the assemblies or the unit monofilaments pass into a first bath of epoxy resin, then they are subjected to heat treatment between 210 and 260° C. for a time of between 20 and 120 seconds, for example at 250° C. for 30 seconds;

they are then passed into a second bath of so-called "RFL" glue, based on latex (for example, butadiene-stirene-vinylpyridine terpolymer), resorcinol and formaldehyde, then they are subjected to heat treatment between 210 and 260 ° C. for a time of between 20 and 120 seconds, for example at 250° C. for 30 seconds.

Before sizing, the assemblies or monofilaments may be subjected to prior activation treatment such as a plasma treatment, for example, as described in Application WO 92/12018 referred to above, or in Application WO 92/12285, for aramid monofilaments.

The assemblies or monofilaments thus sized and treated are then incorporated in known manner, by calendering, into rubber plies for tires, these plies being intended in particular for the crown reinforcement or the carcass reinforcement of radial tires.

Advantageously, the monofilaments according to the invention may be used in oblong form, and therefore do not require any cabling operations, for reinforcing the carcass or the crown of these radial tires, instead of conventional cables formed of a plurality of monofilaments twisted together. At an equivalent ply resistance, the very low thickness D of the oblong monofilaments, compared with cables, makes it possible actually to reduce significantly the thickness of the rubber plies which they reinforce, and hence the manufacturing costs; a low thickness D is furthermore beneficial to the flexion-compression endurance of the monofilaments, and consequently to the endurance of the rubber plies themselves in the tires.

In summary, compared with the as-spun monofilaments of the prior art, the as-spun monofilaments of the invention have a new, essential characteristic: that of not contracting in the hot state.

This property gives them numerous advantages. During the post-polycondensation stage on the support reel, a number of drawbacks are overcome, such as the risk of damage under excessive tension, of "married" filaments, and even of the appearance of "kink-bands"; the prior rewinding operations are no longer necessary. After post-polycondensation treatment, the quality of the products treated is significantly improved thereby; it is therefore no longer necessary in particular to unwind the treated single-threads under low tension or at low speed, which makes it possible to reduce the industrial costs sensibly.

The as-spun monofilaments of the invention, like those in the post-polycondensed state which derive therefrom, compared with those of the prior art have the advantage of having, for a given polymer (given rigidity and anisotropy), a lower tensile modulus which is most frequently combined with a higher elongation at break; it has been noted that such a combination imparts to the monofilaments an improved flexion-compression strength for a given diameter D.

Furthermore, one advantageous characteristic of the spinning process of the invention is that it makes it possible to adjust the rate of thermal dilation of the as-spun monofilaments practically on demand, and even their initial modulus and their elongation at break, according to the intended industrial application; such an adjustment is obtained due to the control of the structuring time ts of the flow of polymer before the liquid quenching, this structuring time ts being a direct function of the diameter D of the intended monofilament.

The as-spun monofilaments of the invention, like those in the post-polycondensed state which derive therefrom, may be used in the state of continuous monofilaments or short fibers; they may possibly be associated with other fibers, threads or monofilaments, for example steel wires, to form, for example, hybrid reinforcement elements.

TABLE 1

| Test No. | ts | ΔL | Te | Mi | Ar |
|---|---|---|---|---|---|
| A-1 | 0.020 | +0.55 | 68 | 2890 | 2.5 |
| B-1 | 0.056 | +0.50 | 69 | 3000 | 2.5 |
| C-1 | 0.076 | +0.45 | 70 | 3270 | 2.3 |
| D-1 | 0.112 | +0.40 | 67 | 3230 | 2.3 |
| E-1 | 0.163 | +0.20 | 70 | 3910 | 2.0 |
| F-1 | 0.397 | −0.10 | 74 | 4340 | 1.9 |

TABLE 2

| Test No. | ts | ΔL | Te | Mi | Ar |
|---|---|---|---|---|---|
| A-2 | 0.056 | +0.15 | 66 | 2400 | 2.7 |
| B-2 | 0.081 | +0.07 | 62 | 2510 | 2.6 |
| C-2 | 0.224 | −0.19 | 63 | 3260 | 2.1 |
| D-2 | 0.407 | −0.25 | 65 | 3360 | 2.0 |

TABLE 3

| Test No. | D | ts | ΔL | Te | Mi | Ar |
|---|---|---|---|---|---|---|
| A-3 | 95 | 0.05 | −0.30 | 58 | 3970 | 1.6 |
| B-3 | 105 | 0.07 | −0.25 | 58 | 3790 | 1.8 |
| C-3 | 122 | 0.09 | −0.25 | 62 | 3930 | 1.8 |
| D-3 | 145 | 0.13 | −0.18 | 62 | 3650 | 1.9 |
| E-3 | 168 | 0.17 | +0.10 | 59 | 2690 | 2.2 |
| F-3 | 203 | 0.25 | +0.20 | 58 | 2470 | 2.4 |
| G-3 | 320 | 0.61 | +0.30 | 50 | 1720 | 2.8 |

TABLE 4

| Test No. | Mi | Ar | Te |
|---|---|---|---|
| A-4 | 2640 | 2.8 | 115 |
| B-4 | 2710 | 2.9 | 126 |
| C-4 | 3360 | 1.7 | 70 |
| D-4 | 3380 | 1.7 | 68 |

We claim:

1. An as-spun monofilament of thermotropic aromatic polyester(amide), characterized in that it satisfies the following conditions:

$80 \leqq D \leqq 230$; $Te > 45$; $\Delta L \geqq 0$, D being its diameter or thickness (in $\mu$m), Te its tenacity (in cN/tex) and ΔL its variation in length (in %) after 2 minutes at 235±5° C. at an initial tension of 0.2 cN/tex.

2. A monofilament according to claim 1, which satisfies the condition $80 \leqq D \leqq 230$.

3. A monofilament according to claim 2, which satisfies the condition $100 \leqq D \leqq 200$.

4. A monofilament according to claim 1, which satisfies the conditions:

Mi<4000; Ar>2, Mi being its initial modulus (in cN/tex) and Ar its elongation at break (in %).

5. A monofilament according to claim 4, which satisfies the conditions:

$$\Delta L \geqq 0.2;\ Ar \geqq 2.5.$$

6. A monofilament according to claim 4, which satisfies the condition:

$$2500 < Mi < 4000.$$

7. A monofilament according to claim 6, which satisfies the condition:

$$3000 \leqq Mi < 4000.$$

8. A monofilament according to claim 1, characterized in that it is made of thermotropic aromatic polyester consisting essentially of recurrent units (A) of 6-oxy-2-naphthoyl and (B) of 4-oxybenzoyl:

A :

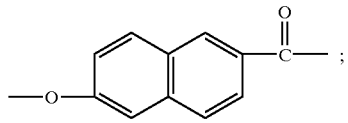

B :

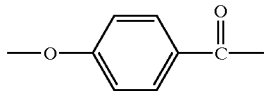

the molar ratio A:B lying within a range from 10:90 to 90:10.

9. A monofilament as set forth in claim 8 in which the molar ratio A:B is within the range 20:80 to 30:70.

10. A monofilament of post-polycondensed thermotropic aromatic polyester derived from an as-spun monofilament in accordance with claim 1.

11. A process for spinning a thermotropic aromatic polyester(amide) for obtaining a monofilament of diameter or thickness D in accordance with claim 1, comprising the following steps:

a) melting the polymer;

b) extruding the molten polymer through a spinneret having at least one extrusion capillary;

c) on emerging from the capillary, structuring the flow of the polymer by stretching in a layer of gaseous fluid for a predetermined time ts;

d) at the end of the time ts, thermally quenching the flow of polymer thus structured by passing it through a quenching liquid so as to solidify it;

e) after drying it, winding the monofilament thus obtained, the time ts (in seconds) being linked to the diameter or thickness D (in $\mu$m) of the as-spun monofilament by the following condition: $ts < 6 \times 10^{-6} D^2$.

12. A process according to claim 11, characterized in that the quenching liquid is water.

13. A process according to claim 11, in which the following condition is satisfied:

$$1.5 \times 10^{-6} D^2 < ts < 6 \times 10^{-6} D^2.$$

14. The use of a monofilament according to claim 1 for the reinforcement of an article of plastic and/or rubber material.

15. An article of plastic material and/or rubber material reinforced by a monofilament according to claim 1.

16. A rubber ply intended for the manufacture of a tire reinforced by a monofilament according to claim 3.

17. A reinforced rubber ply according to claim 16, consisting of a carcass reinforcement ply of a radial tire.

18. A reinforced rubber ply article according to claim 16, consisting of a crown reinforcement ply of a radial tire.

19. A tire reinforced with a monofilament according to claim 3.

* * * * *

UNITED STATES PATENT AND TRADEMARK OFFICE

CERTIFICATE OF CORRECTION

PATENT NO. : 6,550,507 B1 
DATED : April 22, 2003
INVENTOR(S) : Esnault et al.

It is certified that error appears in the above-identified patent and that said Letters Patent is hereby corrected as shown below:

Title page,
Item [56], References Cited, OTHER PUBLICATIONS, insert
-- Patent Abstracts of Japan, Vol. 017, No. 176, JP 04 333616, Nov. 1992, 1 page --

Column 16,
Lines 29-30, "The use of a monofilament according to claim 1 for the reinforcement of an article of plastic and/or rubber material." should read
-- Method for reinforcing an article of plastic and/or rubber material comprising incorporating monofilament of claim 1 into the article of plastic and/or rubber material. --

Signed and Sealed this

Sixteenth Day of September, 2003

JAMES E. ROGAN
*Director of the United States Patent and Trademark Office*